US010570491B2

(12) United States Patent
Hong et al.

(10) Patent No.: US 10,570,491 B2
(45) Date of Patent: Feb. 25, 2020

(54) HIGH ENTROPY ALLOY HAVING COMPOSITE MICROSTRUCTURE

(71) Applicant: The Industry & Academic Cooperation in Chungnam National University (IAC), Daejeon (KR)

(72) Inventors: Sun Ig Hong, Daejeon (KR); Jae Sook Song, Daejeon (KR)

(73) Assignee: The Industry & Academic Cooperation in Chungnam National University (IAC), Daejeon (KR)

( * ) Notice: Subject to any disclaimer, the term of this patent is extended or adjusted under 35 U.S.C. 154(b) by 323 days.

(21) Appl. No.: 15/455,649

(22) Filed: Mar. 10, 2017

(65) Prior Publication Data

US 2017/0275745 A1 Sep. 28, 2017

(30) Foreign Application Priority Data

Mar. 11, 2016 (KR) ..... 10-2016-0029570

(51) Int. Cl.
*C22C 30/02* (2006.01)
*C22F 1/16* (2006.01)
(Continued)

(52) U.S. Cl.
CPC ..... *C22F 1/16* (2013.01); *C22C 9/00* (2013.01); *C22C 9/05* (2013.01); *C22C 9/06* (2013.01); *C22C 28/00* (2013.01); *C22C 30/00* (2013.01); *C22C 30/02* (2013.01); *C22C 30/04* (2013.01); *C22C 30/06* (2013.01); *C22C 32/00* (2013.01); *C22C 32/0089* (2013.01);
(Continued)

(58) Field of Classification Search
CPC ..... Y10T 428/12903; Y10T 428/1291; Y10T 428/12917; Y10T 428/12931; C22C 30/02; C22C 30/00; C22C 30/04; C22C 30/06; C22C 28/00; C22C 9/00; C22C 9/05; C22C 9/06; C22C 32/00; C22C 32/0089; C22C 45/00; C22C 45/001; C22C 45/008; C22C 45/02; C22C 45/04; C22C 49/00; C22C 49/02; C22C 49/08; C22C 49/10; C22C 49/14; C22F 1/16; C22F 1/08; C22F 1/10; C22F 1/18; C22F 3/00
See application file for complete search history.

(56) References Cited

U.S. PATENT DOCUMENTS

2008/0031769 A1* 2/2008 Yeh ..... C22C 1/002 420/580
2009/0074604 A1 5/2009 Chen et al.
2013/0108502 A1 5/2013 Bei et al.

FOREIGN PATENT DOCUMENTS

KR 1020160014130 A 2/2016

OTHER PUBLICATIONS

Cantor, B, et al., "Microstructural development in equiatomic multicomponent alloys", Materials Science and Engineering A, 2004, pp. 213-218, vols. 375-377, Elsevier.
(Continued)

*Primary Examiner* — Michael E. La Villa
(74) *Attorney, Agent, or Firm* — The Webb Law Firm

(57) ABSTRACT

A metallic alloy, more particularly, a high-entropy alloy with a composite structure exhibits high strength and good ductility, and is used as a component material in electromagnetic, chemical, shipbuilding, machinery, and other applications, and in extreme environments, and the like.

4 Claims, 8 Drawing Sheets
(6 of 8 Drawing Sheet(s) Filed in Color)

(51) Int. Cl.

| | |
|---|---|
| ***C22C 9/05*** | (2006.01) |
| ***C22C 32/00*** | (2006.01) |
| ***C22C 9/00*** | (2006.01) |
| ***C22C 30/00*** | (2006.01) |
| ***C22C 30/06*** | (2006.01) |
| ***C22C 30/04*** | (2006.01) |
| ***C22C 9/06*** | (2006.01) |
| ***C22C 28/00*** | (2006.01) |
| ***C22C 45/00*** | (2006.01) |
| ***C22C 45/04*** | (2006.01) |
| ***C22C 49/00*** | (2006.01) |
| ***C22C 45/02*** | (2006.01) |
| ***C22C 49/08*** | (2006.01) |
| ***C22C 49/10*** | (2006.01) |
| ***C22C 49/14*** | (2006.01) |
| ***C22C 49/02*** | (2006.01) |
| ***C22F 3/00*** | (2006.01) |
| ***C22F 1/10*** | (2006.01) |
| ***C22F 1/18*** | (2006.01) |
| ***C22F 1/08*** | (2006.01) |

(52) U.S. Cl.

CPC ..... *C22C 45/00* (2013.01); *C22C 45/001* (2013.01); *C22C 45/008* (2013.01); *C22C 45/02* (2013.01); *C22C 45/04* (2013.01); *C22C 49/00* (2013.01); *C22C 49/02* (2013.01); *C22C 49/08* (2013.01); *C22C 49/10* (2013.01); *C22C 49/14* (2013.01); *C22F 1/08* (2013.01); *C22F 1/10* (2013.01); *C22F 1/18* (2013.01); *C22F 3/00* (2013.01); *Y10T 428/1291* (2015.01); *Y10T 428/12903* (2015.01); *Y10T 428/12917* (2015.01); *Y10T 428/12931* (2015.01)

(56) References Cited

OTHER PUBLICATIONS

Park, Nokeun, et al., "Recrystallization Behavior of CoCrCuFeNi High-Entropy Alloy", Metallurgical and Materials Transactions A, Apr. 2015, pp. 1481-1487, vol. 46A.

* cited by examiner

HIGH ENTROPY ALLOY HAVING COMPOSITE MICROSTRUCTURE

CROSS-REFERENCE TO RELATED APPLICATION

This application claims priority to Korean Patent Application No. 10-2016-0029570 filed Mar. 11, 2016, the disclosure of which is hereby incorporated in its entirety by reference.

BACKGROUND

The present disclosure relates to a metal alloy for a component material used in electromagnetic, chemical, shipbuilding, machinery, and other applications, in addition to components, structural materials, and the like, used in an extreme environment and, in particular, to a high-entropy alloy having a composite structure.

Due to technological breakthroughs in industrial technology, metals and alloys according to the related art have limitations in meeting characteristics required for various materials. To satisfy requirements for multi-functionality, as a novel alloy, a new type of material referred to as a high-entropy alloy has recently been proposed and developed.

A high-entropy alloy refers to not a compound formed by reducing free energy due to the formation of an intermetallic compound, but an alloy with a ductile single phase or multi-phase structure formed by reducing total free energy due to a significant increase in configuration entropy by mixing several elements. In other words, a high-entropy alloy refers to not an intermetallic compound or an amorphous alloy with negligible or limited ductility consisting of multi-component alloying elements, but an alloy with solid solution matrix formed by an atomic scale mixture of several alloying elements without any significant preferential attraction between specific elements.

A high-entropy alloy is disclosed in Non-Patent Document 1 (Materials Science and Engineering A, Vol. 375-377, 2004, page 213-218). In Non-Patent Document 1, a multi-element alloy, $Fe_{20}Cr_{20}Mn_{20}Ni_{20}Co_{20}$, that the researchers expected to form an amorphous phase or complex intermetallic compound, unexpectedly form a single-phase crystalline face-centered cubic (FCC) solid solution, thereby attracting the interest of material scientists and engineers. Most high-entropy alloys exhibit unusual characteristics such as the formation of a single phase structure, even when alloying elements are mixed in similar amounts in a quartenary, quinary, or higher system, in contrast to the conventional alloy systems in which minor additional alloying elements are added to a major alloying element with the content over 60 weight % to 90 weight % in order to induce precipitates or particles. Unique characteristics are also found in an alloy system in which configuration entropy due to mixing is high.

A high-entropy alloy contains four or more types of metallic elements having an atomic content between 5 at. % and 35 at. %, and is an alloy system in which all alloying elements behave as a main element. Due to a similar atomic fraction of elements existing in an alloy, a high degree of mixing entropy is induced. Therefore, instead of the formation of brittle intermetallic compound or an intermediate compound, a solid solution having a stable and simple structure at high temperature is formed.

As prior art related to high-entropy alloys, there are provided Patent Document 1 (U.S. Laid-Open Patent No. US 2013/0108502 A1) and Patent Document 2 (U.S. Laid-Open Patent No. 2009/0074604 A1). In Patent Document 1, disclosed is a high-entropy alloy having a high degree of hardness and high modulus, an alloy system containing five or more types of metallic elements, in which each element such as vanadium (V), niobium (Nb), tantalum (Ta), molybdenum (Mo), titanium (Ti), or the like is included with a deviation of ±15 atomic % or less, and in which there is no distinction between major and minor elements because of the similar atomic contents in the alloy. In addition, the high-entropy alloy is formed as a single phase solid solution having a face-centered cubic and/or body-centered cubic structure. However, in Patent Document 1, different types of relatively expensive and heavy alloying elements are added, and a difficulty in a manufacturing process is expected due to a large difference in melting points among added alloying elements.

Meanwhile, in Patent Document 2, disclosed is a high-entropy alloy having a high degree of hardness, manufactured in a powder metallurgy process using a ceramic phase (representatively, tungsten carbide) and multi-component high-entropy alloy powder. The high-entropy alloy with hard ceramic particles is manufactured with the single phase solid solution matrix embedded with hard ceramic particles, having high strength and excellent high temperature properties. However, in Patent Document 2, since a high temperature process is required when a ceramic material is used to manufacture an alloy with hard ceramic particles, a problem associated with high temperature sintering process such as low toughness is expected to occur due to the presence of the interface defects.

SUMMARY

An aspect of the present disclosure provides a high-entropy alloy with a composite structure, without a relatively expensive and heavy alloying element or ceramic element being added thereto, having excellent strength and ductility through microstructure modification of the high-entropy alloy, by inducing partial phase separation and the composite structure with a soft second phase and maintaining a high-entropy solid solution matrix by heat treatment and deformation processing, and a method of manufacturing the same.

According to an aspect of the present disclosure, a high-entropy alloy having a composite structure, includes: by weight %, iron (Fe) greater than 5% to 35% or less, manganese (Mn) greater than 5% to 35% or less, nickel (Ni) greater than 5% to 35% or less, and cobalt (Co) greater than 5% to 35% or less, and includes at least one of copper (Cu) greater than 3% to 40% or less and silver (Ag) greater than 3% to 40% or less, wherein a ductile second phase is distributed in a matrix of the high-entropy alloy.

According to another aspect of the present disclosure, a method of manufacturing a high-entropy alloy having a composite structure, includes: preparing a metallic material comprising, by weight %, Fe greater than 5% to 35% or less, Mn greater than 5% to 35% or less, Ni greater than 5% to 35% or less, and Co greater than 5% to 35% or less, and including at least one of Cu greater than 3% to 40% or less and Ag greater than 3% to 40% or less; manufacturing an alloy by melting the metallic elements having been prepared in one of casting, arc melting, and powder metallurgy methods; homogenization heat treatment having been manufactured; and cooling the alloy after the homogenization heat treating.

BRIEF DESCRIPTION OF DRAWINGS

The patent or application file contains at least one drawing executed in color. Copies of this patent or patent application publication with color drawings will be provided by the Office upon request and payment of the necessary fee.

The above and other aspects, features, and advantages of the present disclosure will be more clearly understood from the following detailed description taken in conjunction with the accompanying drawings, in which:

FIG. 1A illustrates a microstructure before deformation processing including rolling, drawing and extrusion, and FIG. 1B illustrates a microstructure after deformation processing;

DETAILED DESCRIPTION

Figure 1A:
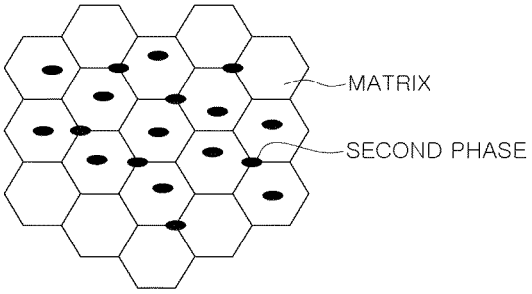
FIGS. 1A and 1B are diagrams illustrating a microstructure of a high-entropy alloy with a composite structure according to the present disclosure.

The inventors of the present disclosure conducted research into a method of improving mechanical/physical characteristics such as strength, ductility, and the like of a high-entropy alloy. As a result, compared to an alloy in which various alloy elements form a single-phase face-centered cubic or body-centered cubic solid solution, when some compositions of various alloy elements were partially separated therefrom or a different ductile metallic phase was formed instead of hard brittle intermetallic compounds, or when segregation or partial phase separation into ductile phase occurred, it was recognized that ductility and strength were further increased after deformation processing. In addition, when a fine filament structure was distributed through deformation processing, it could be confirmed that a high-entropy alloy with excellent strength and ductility was formed, leading to the present disclosure.

Hereinafter, a high-entropy alloy with a composite structure according to the present disclosure will be described in detail. First, a composition of a high-entropy alloy according to the present disclosure will be described in detail.

A high-entropy alloy according to the present disclosure includes, by weight %, iron (Fe) greater than 5% to 35% or less, manganese (Mn) greater than 5% to 35% or less, nickel (Ni) greater than 5% to 35% or less, and cobalt (Co) greater than 5% to 35% or less, and it is preferable to include at least one of copper (Cu) greater than 3% to 40% or less and silver (Ag) greater than 3% to 40% or less.

Fe, Mn, Ni, and Co are elements forming a high-entropy alloy, are period 4 transition elements, and are elements suitable for formation of a solid solution, or the like, since a difference in atomic radii, and the like, is small. Mn and Ni are elements promoting formation of a face-centered cubic (FCC) solid solution, and Co promotes refinement of a structure. Here, the content of the elements being greater than 5% to 35% or less is to induce a change in a portion of entropy in a uniform and homogeneous microstructure, in which a degree of entropy is significantly increased by as much as possible, high enough for formation of a solid solution.

Meanwhile, Cu and Ag are elements not for formation of a complete solid solution with Fe, Mn, Ni, and Co, but for partial separation and the formation of a ductile phase to be separated therefrom. Thus, the elements serve to increase ductility, and serve to enhance strength as a filament is formed by elongating the phase after deformation processing. Here, the content of Cu and Ag being greater than 3% to 40% or less is to induce an increase in ductility and strength due to partial separation of the ductile second phase, depending on fraction of a separated phase.

Hereinafter, a microstructure of a high-entropy alloy according to the present disclosure will be described in detail. FIG. 1 is a diagram schematically illustrating a microstructure of a high-entropy alloy according to the present disclosure, and the present disclosure will be described in detail with reference to FIG. 1.

Figure 1B:
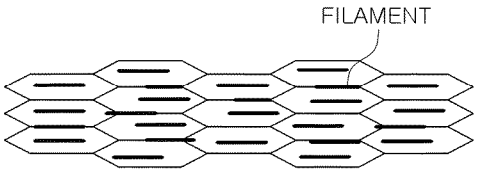

In a microstructure of a high-entropy alloy according to the present disclosure, it is preferable that a ductile second phase be distributed in a matrix, a single phase solid solution, as illustrated in FIG. 1A. Meanwhile, after deformation processing so as to turn the ductile second phase into elongated filaments, as illustrated in FIG. 1B, in a high-entropy alloy according to the present disclosure, it is preferable that a filament structure formed by stretching a ductile second phase be distributed in a matrix.

The matrix refers to a solid solution formed by elements such as Fe, Mn, Ni, and Co.

The second phase refers to various forms or structures, not solidified in the matrix, such as a solid solution of a phase having a different element (a second solid solution), a single phase dendrite, segregation, a phase separation region, a particle, and the like. In other words, the second phase may refer to a structure different from the matrix. The second phase is distributed, thereby allowing a high-entropy alloy to ensure excellent ductility and strength through distribution of ductile second phase particles, filaments and other forms of ductile second phase.

The second phase is a Cu-rich phase(Cu—Mn—Ni phase) or an Ag-rich phase (Ag—Mn phase), which is not fully dissolved in the matrix of a high-entropy alloy, a solid solution. The phase described above is a phase having ductility higher than that of a matrix after casting, thereby having an effect of increasing ductility of a high-entropy alloy. Meanwhile, after deformation processing such as rolling, drawing, extrusion or the like of a high-entropy alloy, the phase described above is stretched to be elongated as a filament, thereby enhancing the strength.

Figure 2A:
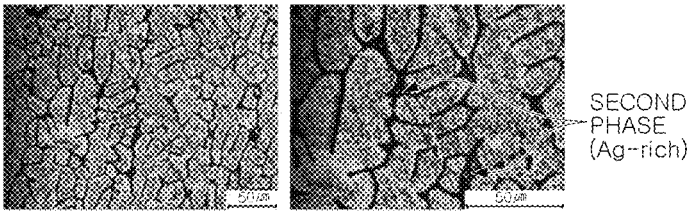
FIGS. 2A and 2B are images of microstructures of inventive examples 3 and 4, respectively.
Figure 2B:
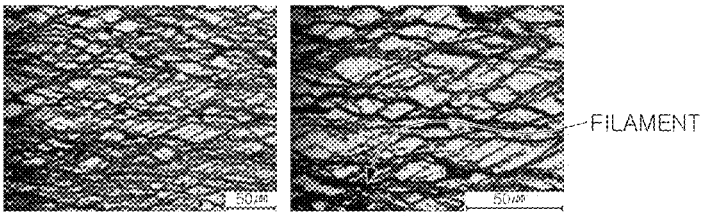
Figure 3A:
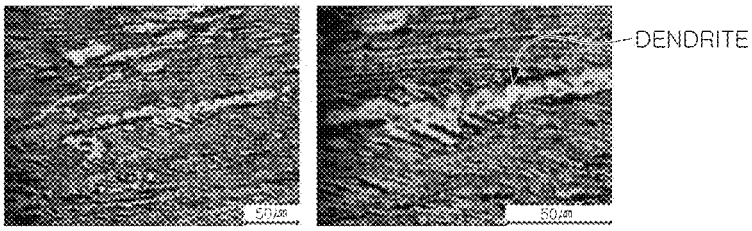
FIGS. 3A and 3B are images of microstructures of inventive examples 1 and 2, respectively.
Figure 3B:
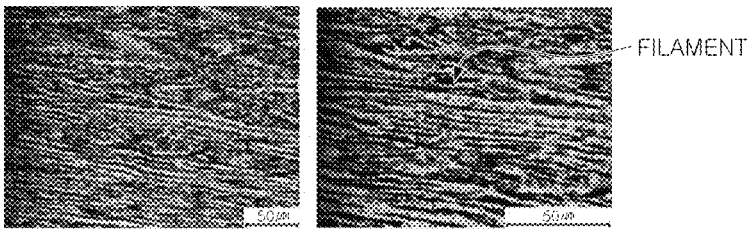

The second phase exists while having a width of 5 μm to 20 μm and a length of 30 μm to 300 μm before processing, as illustrated in FIGS. 2A and 3A. Meanwhile, as illustrated in FIGS. 2B and 3B, after processing, the second phase is stretched. Thus, the second phase exists as an elongated filament having a thickness of 0.05 μm to 2 μm and a length of 10 μm to 1000 μm, and thus, a matrix may be strengthened. When the filament exists while having a thickness of 0.05 μm to 2 μm and a length of 10 μm to 1000 μm, the filament is not damaged by deformation and deformation resistance is optimized, thereby enhancing strength. The stretched filament exists to be elongated in a high-entropy alloy, and thus, an interface existing as an obstacle to deformation is provided. Thus, the filament serves to strengthen a matrix of a high-entropy alloy.

In the case of a high-entropy alloy having a filament structure due to the processing, a technical effect of simultaneously improving strength and ductility may be provided.

Figure 4:
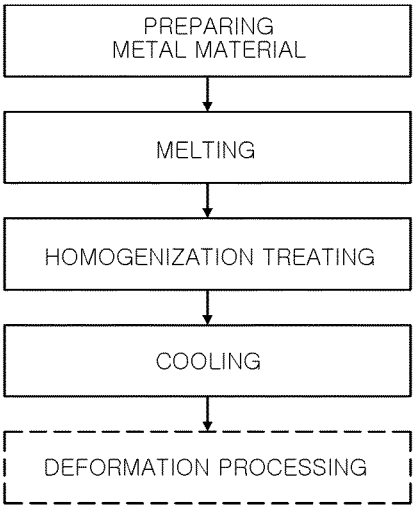
FIG. 4 is a flowchart illustrating an example of a manufacturing method according to the present disclosure.

Hereinafter, a method of manufacturing a high-entropy alloy according to the present disclosure will be described in detail. FIG. 4 illustrates a schematic procedure of a manufacturing method according to an exemplary embodiment. Next, a manufacturing method according to the present disclosure will be described in detail with reference to FIG. 4.

According to the present disclosure, preparing a metal material including, by weight %, Fe greater than 5% to 35% or less, Mn greater than 5% to 35% or less, Ni greater than 5% to 35% or less, and Co greater than 5% to 35% or less, and including at least one of Cu greater than 3% to 40% or less and Ag greater than 3% to 40% or less, is included therein; and melting, homogenization heat treating, and cooling are also included. Processing a high-entropy alloy manufactured thereby may be added thereto.

The melting process is provided to alloy a manufactured metallic material, a method therefor is not particularly limited in the present disclosure, and a method commonly used in a technical field of the present disclosure may be used. For example, the alloy may be manufactured in casting, arc melting, powder metallurgy, and other methods.

Next, the manufactured alloy is homogenization heat treated. Homogenization is a process for inducing diffusion, and it is preferable to maintain an alloy in a temperature range of 900° C. to 1200° C. for 1 hour to 48 hours.

Cooling is performed after the homogenization heat treating. A cooling method is not particularly limited, and a method of air-cooling, water-quenching or furnace-cooling may be performed. Through the cooling process, a phase, in which some compositions are separated from a microstructure or having ductility of a different composition, may be formed. Alternatively, segregation or phase separation may occur. Thus, forming a small precipitate.

With respect to a high-entropy alloy manufactured in the method described above, further processing may be performed. In the present disclosure, a deformation processing method is not particularly limited, and a processing method according to the related art performed in a technical field of the present disclosure may be applied. For example, hot working, rolling, drawing, room temperature processing, and the like may be used. By the deformation processing, as illustrated in FIG. 1B, a second phase inside a high-entropy alloy matrix is changed into a filamentary structure. In other words, when deformation processing is performed, a high-entropy alloy according to the present disclosure has a technical effect of simultaneously improving strength and ductility.

Hereinafter, an exemplary embodiment of the present disclosure will be described in detail. An exemplary embodiment described below is merely to provide an understanding of the present disclosure, and the present disclosure is not limited thereto.

Examples

First, as illustrated in Table 1, high-entropy alloys with the composite structure, according to comparative examples 1 through 3 and inventive examples 1 through 5, were manufactured.

A metal material having a composition (by weight %) of Table 1 was prepared, and the metal material was arc melted in air or a vacuum or argon atmosphere to manufacture an alloy. Thereinafter, homogenization heat treatment was performed at 1050° C. for 24 hours.

Meanwhile, with respect to the high-entropy alloys with the composite structure manufactured as described above, according to comparative examples 1, 2, and 3 and inventive examples 1, 2, 3, 4, and 5, deformation processing including rolling was performed at room temperature to manufacture a board having a thickness of 1 mm.

With respect to the high-entropy alloys manufactured as described above, a tensile test was carried out and mechanical properties were evaluated. The mechanical properties are illustrated in Table 1.

TABLE 1

| Classification | Alloy | Microstructure | Tensile strength (MPa) | Yield strength (MPa) | Elongation (%) |
|---|---|---|---|---|---|
| Comparative example 1 | $Co_{20}Cr_{20}Fe_{20}Mn_{22}Ni_{18}$ | Single phase | 620 | 480 | 40 |
| Comparative example 2 | $Fe_{25}Ni_{25}Co_{25}Cr_{25}$ | Single phase | 1000 | 870 | 35 |
| Comparative example 3 | $Fe_{20}Mn_{20}Ni_{20}Co_{20}Cr_{20}$ | Single phase | 760 | 640 | 17 |
| Inventive example 1 | $Fe_{20}Ni_{20}Co_{20}Mn_{20}Cu_{20}$ | Matrix + dendrite | 1020 | 730 | 46 |
| Inventive example 2 | $Fe_{20}Ni_{20}Co_{20}Mn_{20}Cu_{20}$ | Matrix + filament | 1633 | 1460 | 32 |
| Inventive example 3 | $Fe_{20}Ni_{20}Co_{20}Mn_{20}Ag_{20}$ | Matrix + Ag-rich phase | 1080 | 923 | 43 |
| Inventive example 4 | $Fe_{20}Ni_{20}Co_{20}Mn_{20}Ag_{20}$ | Matrix + filament | 1794 | 1645 | 29 |
| Inventive example 5 | $Fe_{17.5}Ni_{17.5}Co_{17.5}Mn_{17.5}Cu_{30}$ | Matrix + filament | 1435 | 1225 | 21 |

As illustrated in Table 1, in the case of inventive example 1 including a second phase (a dendrite) in a matrix and inventive example 3 including an Ag-rich phase in a matrix, while satisfying a composition according to the present disclosure, strength was excellent, as compared to a comparative example. In addition, elongation exceeded 40%, and thus, excellent ductility was confirmed. In the case of inventive examples 2, 4, and 5, having a structure of a filament formed by stretching a ductile second phase by deformation processing, high strength and excellent elongation were ensured.

Meanwhile, FIGS. 2A and 2B are images of inventive examples 3 and 4, respectively. In FIG. 2A, a microstructure before deformation processing is confirmed that an Ag-rich phase, not fully solidified in a matrix, exists in the matrix. In FIG. 2B, a microstructure after deformation processing is confirmed that the Ag-rich phase has a filament structure.

FIGS. 3A and 3B are images of inventive examples 1 and 2, respectively. In FIG. 3A, a microstructure before deformation processing is confirmed to have a structure in which a dendrite phase exists in a matrix. In FIG. 3B, a microstructure after deformation processing is confirmed to have a filament structure in which the dendrite phase is thinly elongated.

Figure 5A:
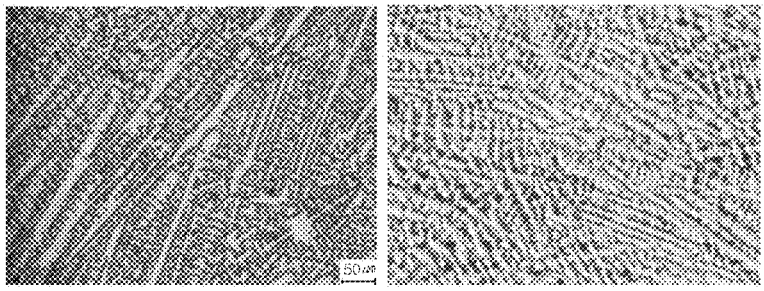
FIGS. 5A and 5B are images of microstructures of inventive example 5, respectively.
Figure 5B:
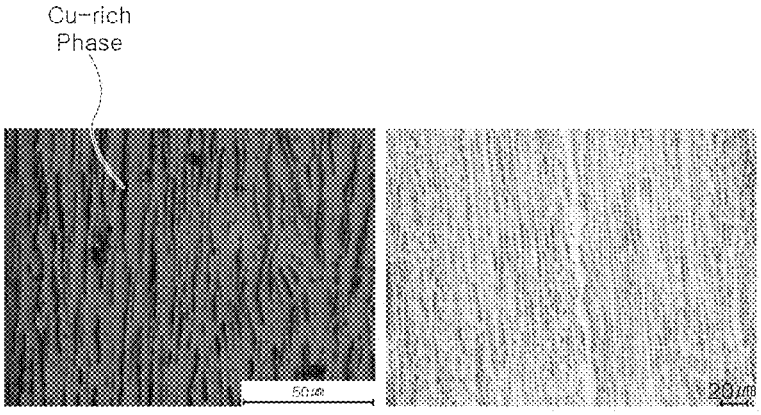

In addition, FIGS. 5A and 5B are images of inventive example 5. In FIG. 5A, a microstructure before deformation processing is confirmed to have a structure in which a dendrite phase exists in a matrix. In FIG. 5B, a microstructure after deformation processing is confirmed to have a filament structure the Cu-rich phase(Cu—Mn—Ni phase) is thinly elongated.

Figure 6A:
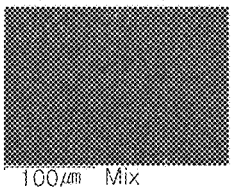
FIG. 6A is a scanning electron microscope image of a microstructure after casting of inventive example 1.
Figure 6B:
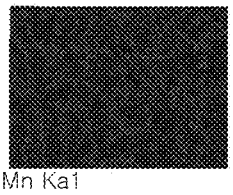
FIGS. 6B through 6F are elemental mapping images of Mn, Fe, Co, Cu, and Ni alloying elements, respectively, for FIG. 6A.
Figure 6C:
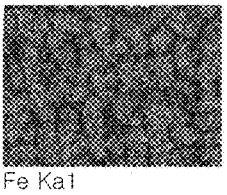
Figure 6D:
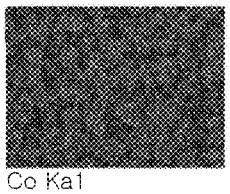
Figure 6E:
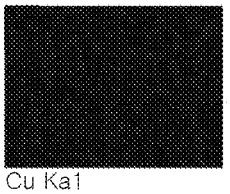
Figure 6F:
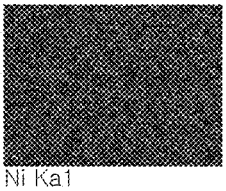

Meanwhile, FIG. 6A is an electron microscope image of a microstructure after casting of inventive example 1. FIGS. 6B through 6F are images of a mapping image of Mn, Fe, Co, Cu, and Ni alloying elements, respectively. In addition, in Table 2, energy dispersive spectroscopy (EDS) analysis values with respect to compositions measured in a dendrite arm and a matrix of inventive example 1 are summarized.

TABLE 2

| | Mn (at. %) | Fe (at. %) | Co (at. %) | Ni (at. %) | Cu (at. %) |
|---|---|---|---|---|---|
| Matrix | 19.5 | 21.28 | 22.13 | 19.12 | 18.43 |
| Dendrite arm | 24.97 | 5.01 | 5.71 | 13.14 | 51.18 |

As illustrated in FIG. 6 and Table 2, Cu and Mn are significantly distributed in a dendrite arm, and Co and Fe alloying elements are mainly distributed in a matrix between dendrite arms. In addition, a Ni alloying element is confirmed in a dendrite arm, but mainly distributed in a matrix. In addition, Fe and Co are mainly distributed in a matrix between dendrite arms, but the high content of other alloying elements (Mn, Ni, and Cu), and the like is confirmed. A main alloying element of a dendrite arm is Cu, and a significant amount of Mn and Ni alloying elements is also included therein. Since melting temperatures of Cu and Mn are lower than melting temperatures of Fe and Co, Cu and Mn have a tendency to be separated while being solidified at the beginning. Thus, Cu and Mn may grow as a Cu—Mn dendrite. A melting temperature of an Ni alloying element is higher than melting temperatures of Cu and Mn alloying elements. However, since solid solubility of the Ni alloying element with respect to Cu is significant, a solid solution phase of Ni and Cu is distributed in a matrix in a manner similar to a Cu phase. Cu and Mn forma solid solution at a high temperature (>900° C.). When the content of Mn exceeds 20%, the solid solution is separated into two phases below 700° C.

Figures 7A, 7B, 7C:
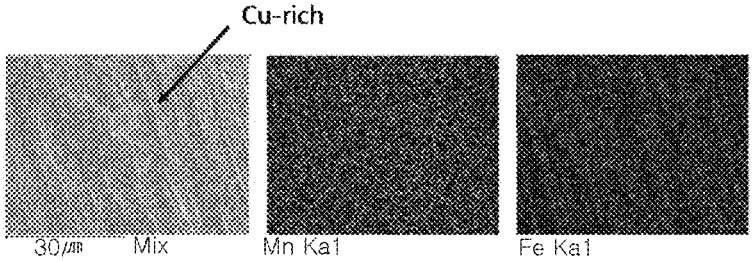
FIG. 7A is an electron microscope image of a microstructure after processing of inventive example 1.
FIGS. 7B through 7F are elemental mapping images of Mn, Fe, Co, Cu, and Ni alloying elements, respectively, for FIG. 7A.
Figures 7D, 7E, 7F:
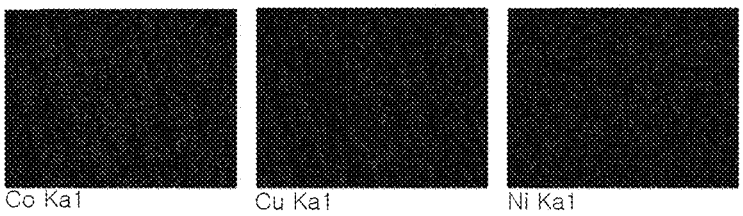

FIG. 7A is an electron microscope image of a microstructure after processing of inventive example 1, and FIGS. 7B through 7F are images illustrating a mapping image of Mn, Fe, Co, Cu, and Ni alloying elements, respectively.

As illustrated in FIG. 7, a filament structure formed by stretching a Cu-rich phase(Cu—Mn—Ni phase), a ductile second phase after deformation processing, is confirmed. A matrix phase and the Cu-rich phase(Cu—Mn—Ni phase) have an FCC structure. When lattice constants of two phases are calculated using Vegard's rule, using elements of Table 1, a difference in a size of lattice constants of two phases is not significant. In XRD spectra, it is difficult to observe phase separation.

Figure 8:
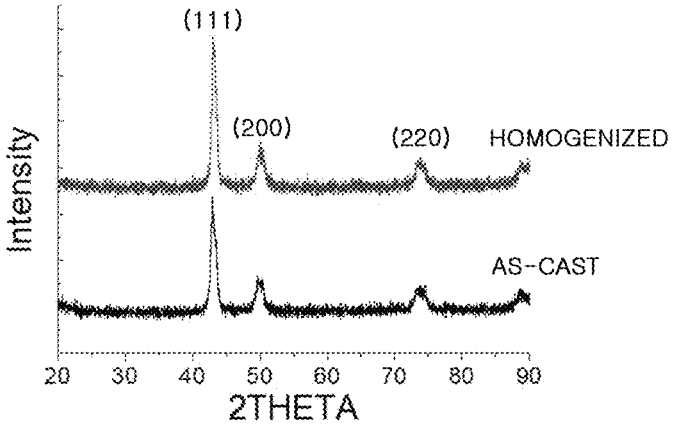
FIG. 8 is an XRD analysis graph of inventive example 1.

FIG. 8 is a graph illustrating an XRD analysis result of inventive example 1. In FIG. 8, diffraction peaks are illustrated as (111), (200), (220), and (311), respectively, and refers to a FCC crystal structure having a lattice constant, a=0.348 nm. In other words, as other peaks are not observed, a FCC crystal structure is confirmed after as-cast and homogenization treatment. In addition, as a portion of a peak (220) is separated on XRD data, it is confirmed that a second phase exists.

As set forth above, according to an exemplary embodiment, through a combination of a matrix and a ductile second phase of a high-entropy alloy, in addition to a shape, a size, and distribution by deformation processing of a ductile phase, excellent strength and ductility may be implemented. Thus, it is advantageous to variously use a high-entropy alloy.

While exemplary embodiments have been shown and described above, it will be apparent to those skilled in the art that modifications and variations could be made without departing from the scope of the present invention as defined by the appended claims.

What is claimed is:

1. A high-entropy alloy having a composite structure, comprising: by weight %, iron (Fe) greater than 5% to 35% or less, manganese (Mn) greater than 5% to 35% or less, nickel (Ni) greater than 5% to 35% or less, and cobalt (Co) greater than 5% to 35% or less, and comprising, by weight %, at least one of copper (Cu) greater than 3% to 40% or less and silver (Ag) greater than 3% to 40% or less, wherein a ductile second phase is distributed in a matrix of the high-entropy alloy and the ductile second phase has a filament structure formed by deformation processing.

2. The high-entropy alloy having a composite structure of claim 1, wherein the ductile second phase is one or more of a Cu-rich phase, an Ag-rich phase, a single phase dendrite, a phase separation region, and a particle.

3. The high-entropy alloy having a composite structure of claim 1, wherein the ductile second phase has a width of 5 μm to 20 μm and a length of 30 μm to 300 μm.

4. The high-entropy alloy having a composite structure of claim 1, wherein the filament structure has a thickness of 0.05 μm to 2 μm and a length of 10 μm to 1000 μm.

* * * * *